United States Patent [19]

Affolter

[11] 4,181,290

[45] Jan. 1, 1980

[54] MANHOLE COVER LIFTING DEVICE

[76] Inventor: Bill G. Affolter, 279 Albert Pl., Costa Mesa, Calif. 92726

[21] Appl. No.: 969,833

[22] Filed: Dec. 15, 1978

[51] Int. Cl.[2] ..... B66F 17/00

[52] U.S. Cl. ..... 254/124; 254/131

[58] Field of Search ..... 254/2 R, 124, 131, 30, 254/120; 294/15, 17, 18

[56] References Cited

U.S. PATENT DOCUMENTS

| | | | |
|---|---|---|---|
| 2,517,813 | 8/1950 | Wallace | 254/124 |
| 3,121,556 | 2/1964 | Faulkner | 254/2 R |
| 3,883,105 | 5/1975 | Matsumoto | 254/124 |
| 3,885,688 | 5/1975 | Larsen | 254/131 |

*Primary Examiner*—Robert C. Watson

[57] ABSTRACT

A manhole cover lifter that is formed by a single arm lever structure with a pair of adjustable lifting jaws that penetrate and attach to a manhole cover to remove and relocate it. The arm also contains adjustable hooks that are for other cover configurations. The invention is stabilized by three retractable legs allowing the lifting arm to rotate horizontally. The lifting power of the arm is provided by an integral hydraulic jack or in other embodiments a hydraulic or pneumatic cylinder or a hand operated cable reel. A wire rope embracing a pulley attached to the vertical column provides a connection between the jack and the arm. This pulley is raised by the jack, or actuating means, subsequently elevating the arm into a vertical position where it is then rotated allowing the cover to be deposited radially away from the manhole.

14 Claims, 10 Drawing Figures

MANHOLE COVER LIFTING DEVICE

BACKGROUND OF THE INVENTION

1. Field of the Invention

This invention relates in general to pushing and pulling implements and more specifically to mechanically actuated or lever supported thrust bar type.

2. Description of the Prior Art

Previously manhole covers located over underground cavities in streets, sidewalks, etc. have been lifted by manual tools such as crowbars, prybars and the like. Some manual devices such as taught in U.S. Pat. Nos. 2,846,259 issued to Sadler and 3,837,622 to Gale utilize levers or provide lifting handles to physically remove the covers. With the advent of government regulations often requiring air ventilation while operating personnel are underground the need for the size of th- manhole has been necessarily increased. This ultimately enlarges the size and weight of the cover making manual lifting devices impractical and difficult to use. Further if the covers are corroded or wedged tight simple lifting devices of these large covers become totally inadequate; in addition, safety regulations limit the amount of weight an individual may lift. Mechanically assisted lifting devices such as disclosed by Mosley in U.S. Pat. No. 3,861,649 utilize a separate conventional hydraulic jack to free and lift the cover but does not provide the means to attach the cover securely or allow it to be rotated to the side away from the hole. Further the employment of more women in situations where lifting of manhole covers is required has provided a need for a device that can be easily carried by any operating personnel and used to lift and move the cover away from the hole. For background purposes and as indicative of the art to which the invention relates reference may be made to U.S. Pat. Nos. 3,885,688 issued to Larsen, 3,521,860 to Zehrung and 4,021,017 issued to Adams.

SUMMARY OF THE INVENTION

Previously devices to lift manhole covers have been limited to mechanical apparati utilizing levers and manual handles or hydraulic actuated spanning bars. The needs of the industry have now dictated the requirement for an advance in this field of the art. It is therefore the primary object of the invention to provide a manhole cover lifting device that will safely attach to and dislodge a cover, elevated into a vertical position, rotate radially and deposit the cover on the ground away from the open hole at a convenient location.

An important object allows the flexibility of multiple hooks and jaws that may be affixed to the manhole cover and remain safely attached while elevating and rotating the cover. This is accomplished by the use of jaws inserted into holes with inverted cone shape bores and adjusted inward to firmly grasp the cover.

An alternate set of hooks may be inserted into opposed holes for covers adapted to this configuration and similarly allow flexibility of interface connection.

Another object provides a light weight portable device capable of being easily lifted by any operating personnel. This is also well within the weight limitation imposed by the government and practical limits of either male or female workers.

Still another object allows the apparatus to be easily folded into a small package to be conveniently carried by hand and stored in the vehicle. The device incorporates this feature by folding the diametrically opposed legs upward to the vertical column and fastens them in place. Also the lifting arm is pivoted upward making a rectangular envelope with the round column easily grasped as a handle.

Yet another object allows the invention to be used in conjunction with a wide array of manhole covers as most contain holes for underground pressure equalization. These openings provide the connection to be used in conjunction with either the holes or the jaws. This feature is common in covers for telephone cables, sewers, water, power, television, etc. and would therefore be compatable with the instant invention.

These and other objects and advantages of the present invention will become apparent from the subsequent detailed description of the preferred embodiment and the appended claims taken in conjunction with the accompanying drawings.

DESCRIPTION OF THE PREFERRED EMBODIMENT

Figure 1:
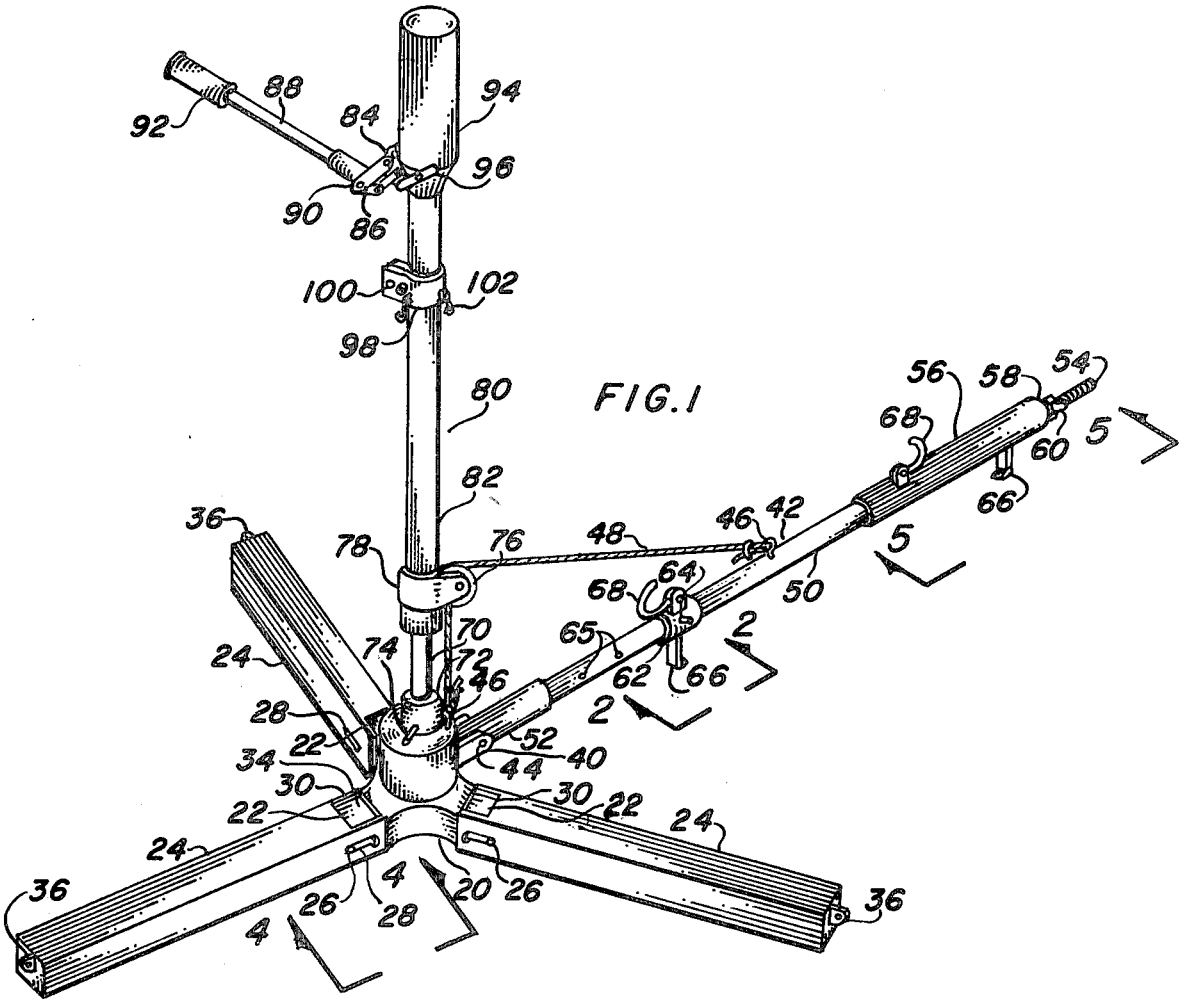
FIG. 1 is a partial isometric view of the preferred embodiment with the lifting arm in a semi-raised position.

Referring now more specifically to the referenced characters of the drawings the invention in the preferred embodiment utilizes a base structure 20 that has a flat bottom suitable for positioning on the ground or other solid surface. The base 20 contains means to slideably and rotatably attach a plurality of legs 24 with male projections 22 being preferred. The projection 22 is slightly smaller than the inside surface of the leg 24 and allows the leg to be slid over the projection 22 firmly and rigidly locking it into place. The pin 26 located horizontally penetrates the base and extends on both ends captivating the leg 24 through a slot 28. This slot 28 is in line with the pin 26 allowing the leg 24 to slide linearly but limiting its travel from fully engaged to clear a window in the top surface of the leg 30. The slot 28 has an elongated circular opening at one end allowing the leg 24 to pivot about a pin 26 to a vertical position with the window in the leg 30 clearing the projection 22 in the base. The base further contains a vertical socket 32 in the upper portion with a flat surface at right angles to the socket. The base structure 20 may be made of any suitable material with aluminum being preferred. The legs 24 are square in shape in the preferred embodiment but may be of any shape such as a rectangle, angle, channel, I beam or the like. On one end of the leg a female socket 34 receives the base projection 22 and on the other end there are vertical attaching means 36 that hold the leg in place when rotated in the upright folded position. The vertical attaching means 36 may consist of straps with buckles, shock cord, U shaped rectangular clips, toggle arrangements with wing nuts however the preference is to hooks and eyes. Aluminum is preferred as the leg material as it is light weight and has sufficient structural integrity for the application however any suitable substance may be utilized such as steel, wood, fiberglass, etc. A base attaching yoke 38 is rotatably affixed to the base 20 and contains a female clevis 40 located horizontally to retain a lifting arm 42. The clevis further contains a pin 44 that captivates the lifting arm 42 allowing it to rotate substantially 90°. The yoke 38 also has an attaching eye 46 for a connecting cable 48 anchored securely to the structure of the yoke 38. The lifting arm 42 consists of a main member 50 being preferably hollow and circular in shape with a stiffening base member 52 slightly larger in diameter containing an opening for the pin 44 on which the arm pivots. The arm 42 is also constructed with a threaded member 54 attached on the end opposite the base member 52. This thread is preferably the so called Acme type with square threads to allow linear thrust to be applied. An adjustable sleeve 56 is slideably attached to the main member 50 with the sleeve internal diameter compatible to the main member external diameter allowing a slip fit of the two elements. The extreme end further contains a closure 58 reducing the internal diameter to more closely approximate the outside diameter of the threaded member 54 also providing a shoulder on the end. A hexagonal shaped nut, wing nut or threaded fastening means 60 is screwed onto the member 54 providing adjustment to the entire sleeve 56 by tightening or loosening as required. A fixed sleeve 62 of similar configuration except shorter is slideably connected to the arm 42 separated from the adjustable sleeve 56. A pin 64 is attached through the sleeve 62 and a plurality of linearly disposed holes 65 in the arm 42 allow major adjustment of the span of the sleeves. The pin 64 may be of any applicable configuration with a spring loaded detent type with opposed balls being preferred. The sleeves 56 and 62 include a plurality of jaws that match the configuration of many manhole covers. One pair being lifting pins 66 linearly opposed on the sleeves in the shape of a inverted truncated cone best depicted in FIGS. 2 and 3 also illustrated attached to the manhole cover in FIG. 6. These pins 66 have two parallel surfaces being the front and back viewed in FIG. 2 with the flat surface at right angles. The mating surfaces of the pins are radiused with the lower surface in an inverted cone shape truncated top with the larger portion protruding at the bottom giving a radius wedge shaped surface to engage the manhole cover. Adjustment of the span is accomplished by roughly sliding the sleeve to the desired hole 65 and positioning with the detent pin 64. The opposed sleeve 56 is then positioned with compression adjustment means by rotating the nut 60 to provide the proper tension on the span wedging the pin 66 tightly against the manhole cover. The second set of jaws or hooks 68 are attached to the sleeves 56 and 62 directly opposed to the pin 66. These hooks 68 are in the shape of a C and are rotatably attached to one end. The hooks 68 further contain an inwardly curved end capable of being inserted into an opening of a manhole cover and rotated inward providing a rigid lifting surface with the end intimately embracing the underside surface of the manhole cover. Span adjusting means is provided by the same nut 60 rotated against the closure 58 with the sleeve 56 captivating the two hooks into the holes in the cover. A vertical upright column structure 70 is rotatably attached to the base structure 20 through the yoke 38. This column interfaces with the yoke 38 through a column base 72 that rests on the yoke in the socket 32 and is retained by a bearing pin 74 allowing rotation of the column substantially 360°. The column further contains a rotatable pulley 76 that is affixed to the column 70 with a bracket 78 positioning the pulley at right angles to the column. Attaching means between the vertical upright column structure 70 and the lifting arm 42 consists of a flexible wire rope 48 that is attached on one end to the base yoke 38 and on the other to the lifting arm 42 with the median embracing the periphery of the pulley 76. When the pulley 76, attached to the column 70, is raised this lengthens the distance from the pulley to the yoke 38 while simultaneously shortening the distance between the pulley and the arm 42. This movement lifts the arm 42 horizontally and subsequently changes the center of gravity of the apparatus. The preferred embodiment best shown in FIG. 1 utilizes mechanical force means to elevate the pulley 76 on the column 70 in the form of a self-contained hydraulic jack 80 integral with the vertical upright column structure. The jack 80 incorporates an expanding and contracting vertical hydraulic cylinder 82 providing linear movement. This cylinder contains a piston connecting rod that has been previously designated the upright vertical column structure 70 attaching to the cylinder 82 which remains stationary while the cylinder itself moves vertically. A master cylinder 84 provides the pressurizing means whereby hydraulic fluid is compressed by manual movement of the piston within the cylinder in conjunction with external linkage 86 which provides a mechanical advantage and converts the radial action to linear force. A lever arm 88 provided with toggle linkage 90 is connected to the master cylinder 84 to be easily grasped and manipulated by hand providing the prime energy for the system. A handle 92 of a resilient material is attached over the arm 88 for convenience of the operator. A reservoir 94 contains the non-compressable hydraulic fluid and stores a sufficient quantity of fluid to fill the hydraulic cylinder 82 in its extreme position. A pressure release valve 96 releaves the pressure in the hydraulic cylinder 82 allowing it to return to the reservoir 94 thereby lowering the entire jack 80. A positioning bracket 98 with a horizontal hole 100 is attached around the cylinder 82 allowing the lever arm 88 to be removed and inserted into the hole 100 assisting in rotating the apparatus when positioning the raised manhole cover. The bracket 98 also contains vertical attaching means in the form of a plurality of hooks 102 that attach to the eyes 36 on the legs 24 retaining them when in the vertical or retracted position.

Figure 8:
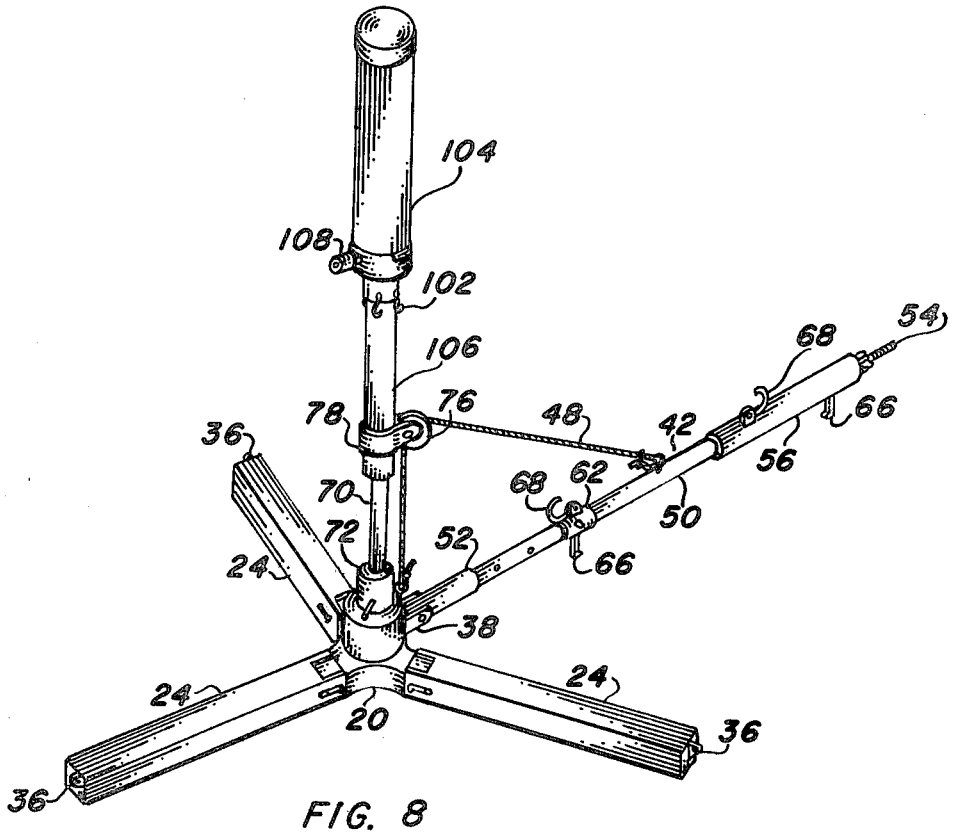
FIG. 8 is a partial isometric view of an embodiment of the invention.

Another embodiment best depicted in FIG. 8 incorporates all of the same elements as shown in FIG. 1 except the linear actuating means is a hydraulic or pneumatic cylinder 104, either working equally well, with an external source of power and control. The cylinder is attached to a secondary upright column 106 and the vertical column structure 70 is connected to the ram of the piston in the cylinder 104. Connection to the external pressure source is located on the side of the cylinder consisting of a quick disconnect coupling 108. The controls are external and the hose need only be connected to operate the device. The remainder of the operation is identical to the above-described embodiment.

Figure 9:
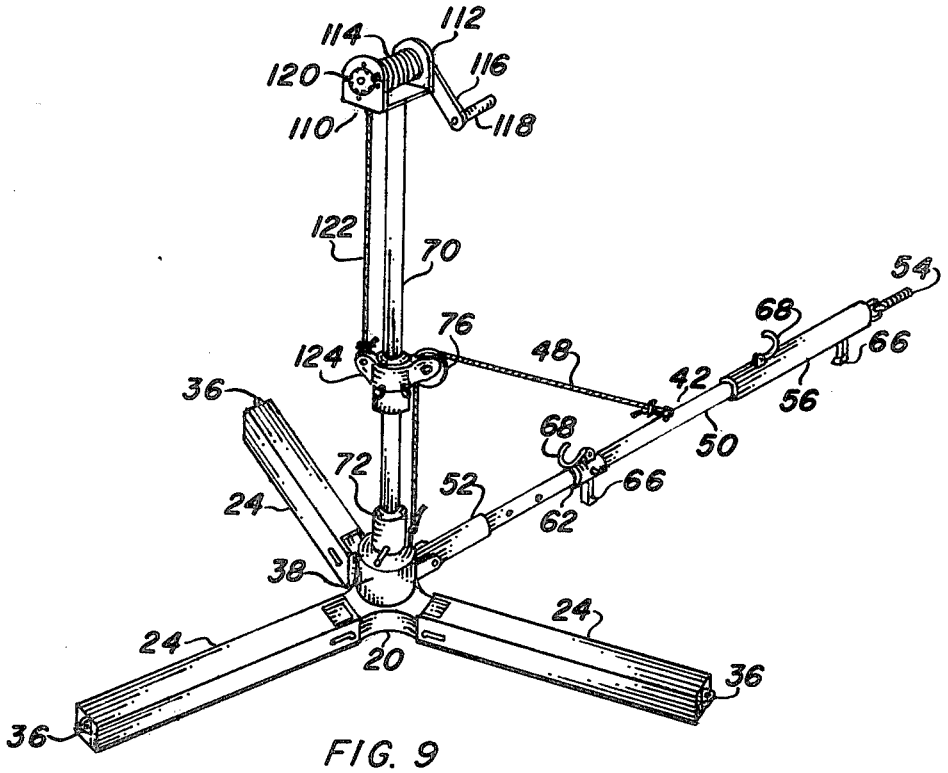
FIG. 9 is a partial isometric view of an embodiment of the invention.

Yet another embodiment pictorily described in FIG. 9 contains the previously described elements except for the mechanical force means. This embodiment utilizes a hand operated winch 110 consisting of a body structure 112, a reel 114, a crank 116, a handle 118 and a spring loaded reversible ratchet stop mechanism 120. A flexible wire rope 122 is stored around the reel 114 and is actuated by rotating the reel to either lengthen or shorten the rope depending upon the rotation. The rope 122 is fastened through a bracket 124 similar to the previously described bracket 78 except a protrusion is incorporated in the side opposite the pulley 76 to attach the rope 122. The bracket 124 also differs in that it is slideably connecting to the vertical column structure 70 which is lengthened in this embodiment to connect directly to the winch 110. The operation is basically similar with the bracket 124 being moved vertically by the shortening action of the rope 122 wrapping around the reel 114 on the winch 110. This movement shortens the span between the arm 42 and upright column structure 70 raising the arm to the vertical position. The arm 42 is lowered by the opposite action. The reversible ratchet 120 on the reel 114 allows the reel to be held in place at the desired position and allows the crank 116 to be rotated at one time in only one direction. The reversing action allows the reel 114 to rotate oppositely therefore lowering the arm 42.

Figure 2:
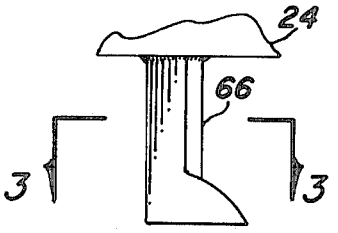
FIG. 2 is a fragmentary elevation view of one of the lifting pin jaws as viewed from Lines 2—2 of FIG. 1.
Figure 3:
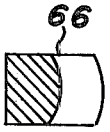
FIG. 3 is a sectional view of one of the lifting pin jaws taken across Lines 3—3 of FIG. 2.
Figure 4:
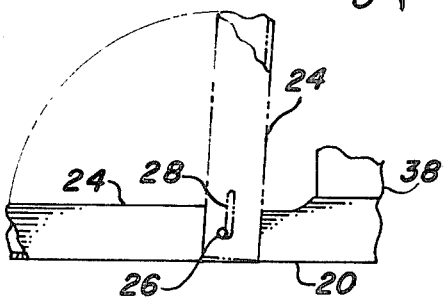
FIG. 4 is a partial view of one of the legs shown in the horizontal position with the vertical position in phantom as viewed from Lines 4—4 of FIG. 1.
Figure 5:
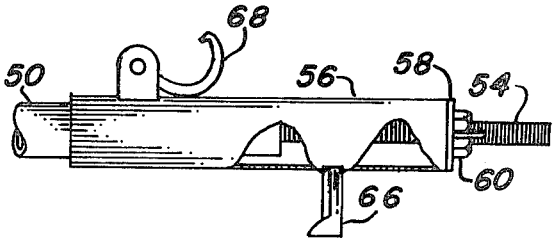
FIG. 5 is a cut-away view of the adjustment means of the manhole lifting cover jaws as viewed from Lines 5—5 of FIG. 1.
Figure 10:
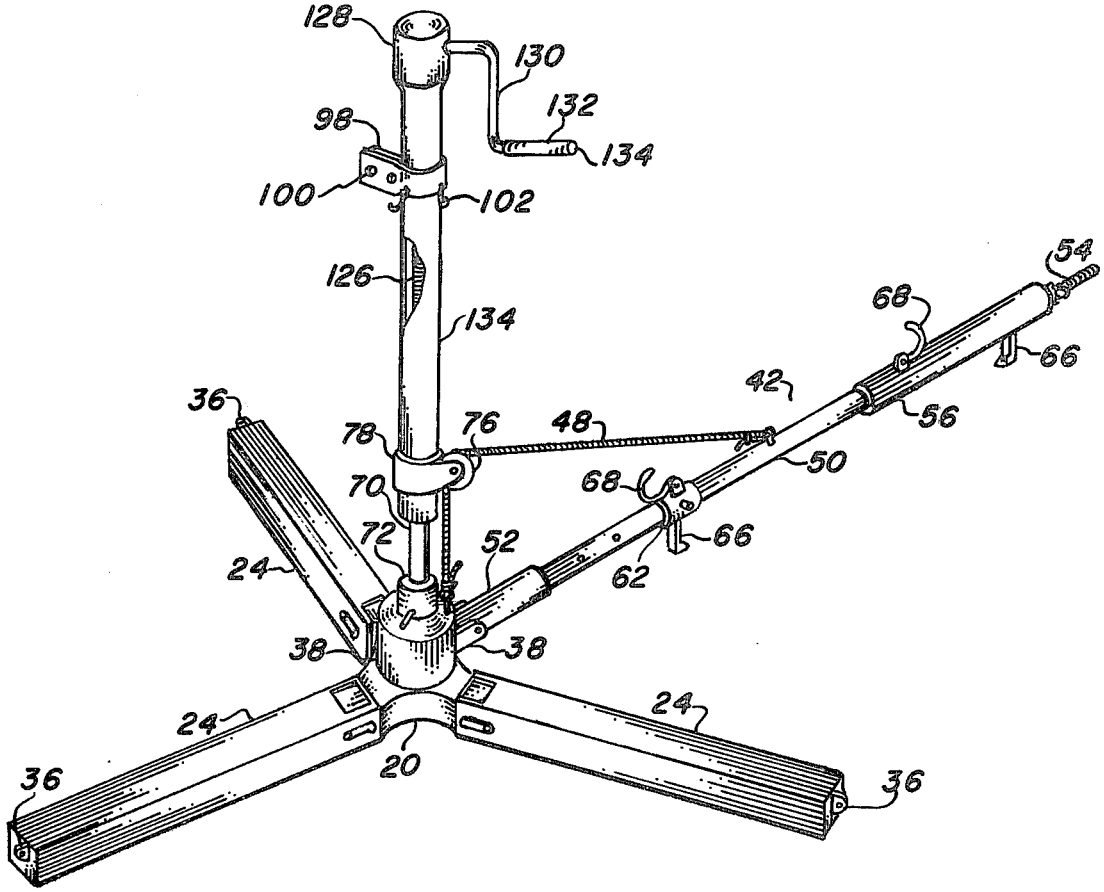
FIG. 10 is a partial isometric view of an embodiment of the invention.

Still another embodiment disclosed in FIG. 10 contains the same elements as described in FIG. 2 except the linear actuating means is a gear actuated threaded stem. The stem 126 enclosed in a housing 134 attaches to the vertical column structure 70 and is extended or contracted by a gear 128 actuated by a hand crank arm 130. The crank arm contains a movable sleeve 132 on the horizontal end 134 that allows the arm to be rotated radially with the sleeve remaining stationary. This allows the operator to apply radial pressure limiting the friction on the crank arm in contact with the hand. The operation is the same as in the preferred embodiment moving the bracket 78 in a vertical direction.

Figure 6:
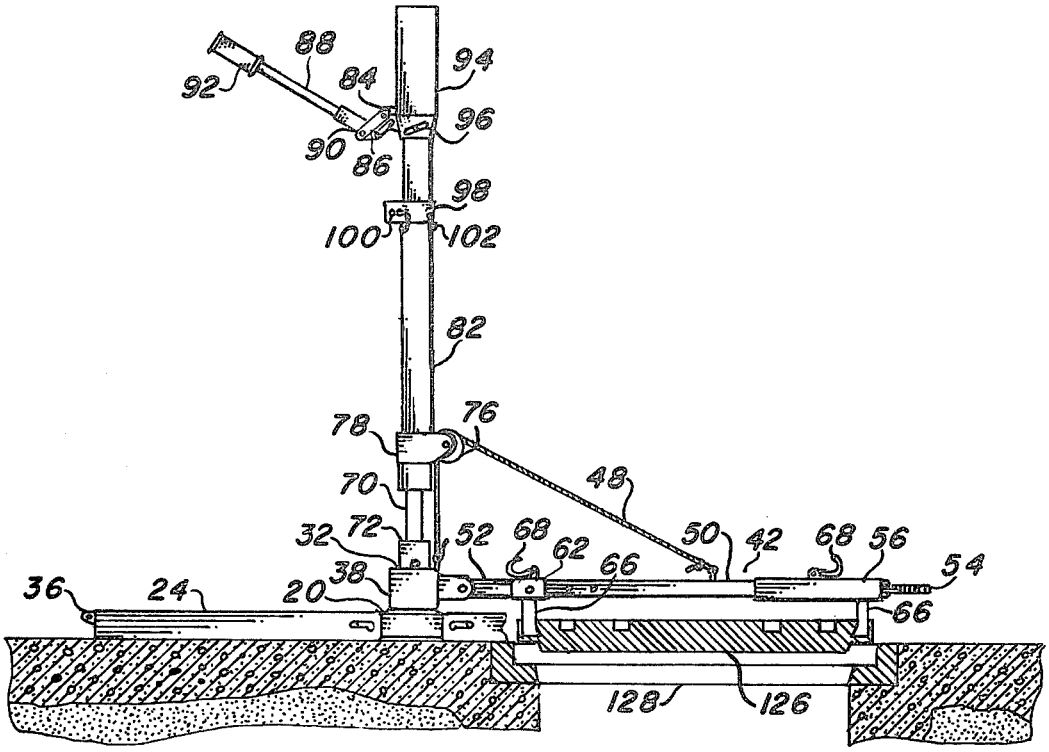
FIG. 6 is a side view of the invention attached to a manhole cover.
Figure 7:
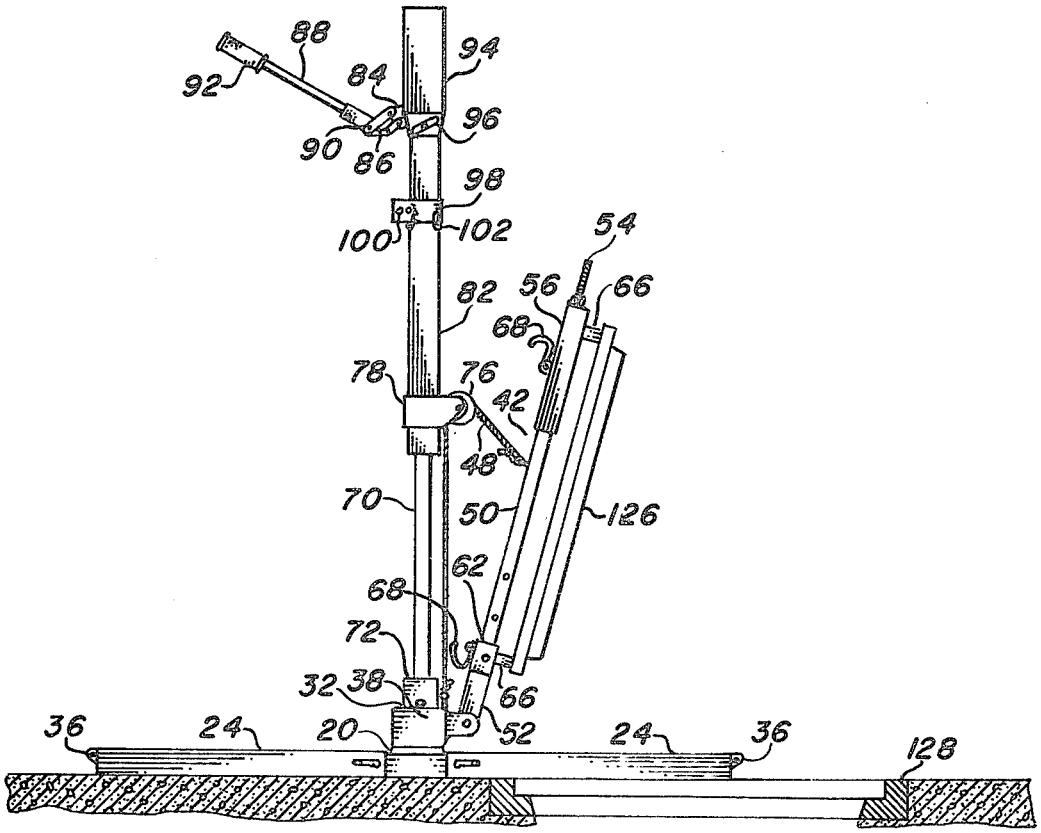
FIG. 7 is a side view of the invention with a manhole cover removed and lifted to a near vertical position.

The operation of the apparatus is best depicted in FIGS. 6 and 7. The device is shown on a concrete surface attached to a manhole cover in FIG. 6 with the arm 42 moved slightly upward freeing and dislodging the cover 126 from the mating ring 128 embedded in concrete. The action allows the arm 42 to be lifted upward pivoting on the yoke 38 with the pulley 76 being raised by the linear actuating means shortening the distance between the pulley and the arm. This arrangements moves the center of gravity upward as the pulley 76 is elevated allowing a low center of gravity during the initial lifting process where most of the force is required and the thrust load is greatest on the leg members 24. This gravity center disposition allows a convenient length leg to be used reducing the overall weight and size of the apparatus and providing easy storage in its collapsed position. FIG. 7 indicates the arm in the near vertical position with the pulley 76 elevated and the rope 48 shortened. The center of gravity is also elevated as the vulcrum point is now higher from the ground surface. However the load is now reduced on the end of the arm as more weight is transmitted in sheer loading on the pin 44 of the yoke 38 thereby allowing stabilization of the device. The arm 42 is free to rotate in either direction substantially 360° to position the manhole cover 126 at any convenient location around the device. The arm 42 may then be lowered and deposit the cover 126 on the ground with the nut 60 being loosened removing the lateral tension on the jaws 66 or hooks 68 and thereby freeing the cover from the apparatus.

Although the invention has been described in complete detail and pictorially shown in the accompanying drawings it is not to be limited to such details since many changes and modifications may be in the invention without departing from the spirit and scope thereof hence it is described to cover any and all modifications and forms which may come within the language and scope of the appended claims.

I claim:

1. A manhole cover lifting device comprising:

(a) a base structure suitable to be positioned on the ground;

(b) a plurality of legs attached to said base structure extending radially being parallel to the ground upon which they are sitting;

(c) a vertical upright column structure rotatably attached to said base structure;

(d) a lifting arm pivotally attached to said upright column structure capable of vertical movement with means for attaching a manhole cover; and (e) linear actuating means to raise and lower said lifting arm and rotating means to rotate it about the axis of the base.

2. A manhole cover lifting device comprising:

(a) a base structure suitable to be positioned on the ground including leg attaching means and upright column structure attaching means;

(b) a plurality of legs attached to said base structure extending radially being parallel to the ground upon which they are sitting;

(c) a vertical upright column structure rotatably attached to said base structure being capable of rotation upon the base substantially 360°;

(d) a lifting arm pivotally and slideably attached to said upright column structure capable of vertical movement on the column and pivoted about the vertical axis of the base; and (e) linear actuating means to raise said lifting arm when attached to a manhole cover removing the cover from its fixed position to a substantially vertical position and rotating means to rotate it away from the hole and depositing it on the ground.

3. A base structure as recited in claim 2 further comprising: a plurality of male projections in which said legs may be slidably attached with retaining means to captivate said legs and a rotatable bearing surface to interface with said upright column structure.

4. A plurality of legs as recited in claim 2 further comprising: a female socket in which said legs may be slideably and rotatably attached to said base structure, with retaining means and vertical attaching means, to engage the legs in the rotated position to said upright column structure when transported or not in use.

5. A lifting arm as recited in claim 2 further comprising: a plurality of manhole cover lifting jaws with positioning means to interface with covers to allow lifting and rotating.

6. The invention according to claim 5 in which said manhole cover lifting jaws comprise: a plurality of lifting pins containing an inverted truncated cone shaped face with compression adjusting means.

7. The invention according to claim 5 in which said manhole cover lifting jaws comprise: a plurality of rotatable C shaped hooks attached on one end capable of being inserted into openings of the manhole cover rotating inward to provide a lifting surface.

8. The invention according to claim 2 in which the linear actuating means comprises: attaching means between said vertical upright column structure and said lifting arm interconnecting the structures with the capability of expanding or contracting in length to raise or lower the arm as manipulated by the operator with mechanical force means.

9. The apparatus as recited in claim 8 wherein mechanical force means further comprise:

(a) a self contained hydraulic jack intregal with said vertical upright column structure with an expanding and contracting vertical hydraulic cylinder providing linear and vertical movement;

(b) a master cylinder through which hydraulic fluid is compressed by manual movement of the piston within the cylinder, with mechanical linkage, to provide fluid under pressure to said vertical hydraulic cylinder;

(c) a lever arm with toggle linkage to connect said arm to said master cylinder for manual operation to compress said hydraulic fluid;

(d) a reservoir to contain hydraulic fluid and provide a sufficient quantity of stored fluid to fill said vertical hydraulic cylinder; and (e) a pressure release valve to relieve the pressure in said hydraulic cylinder and return same to said reservoir therefore lowering said cylinder.

10. The invention according to claim 8 in which said attaching means between said vertical upright column structure and said lifting arm further comprise: a flexible wire rope attached on one end to said base and the other end of said lifting arm with the median embracing the periphery of a rotatable pulley that is affixed to said vertical column to lift said arm horizontally when said cylinder is expanded.

11. The invention according to claim 8 in which the mechanical force means comprise: a hydraulic cylinder attached to said vertical upright column structure to raise or lower said lifting arm.

12. The invention according to claim 8 in which the mechanical force means comprise: a pneumatic cylinder attached to said vertical upright column structure to raise or lower said lifting arm.

13. The invention according to claim 8 in which the mechanical force means comprise: a winch with a flexible rope and a head crank arm with the rope directly connected to a bracket included in said attaching means between said vertical upright column structure and said lifting arm to enable the operator to lift the arm by rotating the crank arm and hold it in place with ratchet stop means.

14. The invention according to claim 8 in which the mechanical force means comprise: a gear actuated threaded stem with a hand crank arm attached thereto to raise and lower said upright column structure by manually rotating said hand crank arm enabling an operator to raise and lower said arm.

* * * * *